US007462056B2

(12) United States Patent
Yeh et al.

(10) Patent No.: US 7,462,056 B2
(45) Date of Patent: Dec. 9, 2008

(54) ELECTRICAL CONNECTOR ASSEMBLY

(75) Inventors: Hung-Yang Yeh, Tu-Cheng (TW); Hsiu-Yuan Hsu, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/789,140

(22) Filed: Apr. 24, 2007

(65) Prior Publication Data

US 2007/0249207 A1 Oct. 25, 2007

(30) Foreign Application Priority Data

Apr. 24, 2006 (TW) ..... 95206935

(51) Int. Cl.
*H01R 13/62* (2006.01)

(52) U.S. Cl. ..... 439/331; 439/73

(58) Field of Classification Search ..... 439/331, 439/330, 71, 70, 525, 526, 259
See application file for complete search history.

(56) References Cited

U.S. PATENT DOCUMENTS 5,545,050 A * 8/1996 Sato et al. ..... 439/331
5,788,513 A * 8/1998 Kajiwara et al. ..... 439/72
6,676,418 B2 * 1/2004 Watanabe ..... 439/71
6,749,443 B2 * 6/2004 Sano et al. ..... 439/71
6,811,407 B2 * 11/2004 Watanabe ..... 439/66
6,896,546 B2 * 5/2005 Ichihara et al. ..... 439/526
6,957,967 B2 * 10/2005 Petersen et al. ..... 439/78

* cited by examiner

*Primary Examiner*—Hien Vu
(74) *Attorney, Agent, or Firm*—Wei Te Chung

(57) ABSTRACT

An electrical connector assembly (1) comprises a housing (10), an operating member (11), a cover (12) pivotally engaged in one side of the housing (10), a shaft (14) for connecting the cover (12) to the housing (10) and a plurality of terminals (13). The operating member (11) defines a number of receiving holes (110), and the housing (10) defines a plurality of passageways (100) corresponding to the receiving holes (110). The terminal (13) comprises a contact engaging portion (131) received in the housing (10) for contacting with the chip module (2), an retaining portion (132) received in the received hole (110), a tail (1) connecting to the printed circuit board and a neck portion (134) connecting the retaining portion (132) and the contact engaging portion (131). The operating member (11) is floatably supported by a first projection (1341) formed on the first connecting portion (134).

4 Claims, 8 Drawing Sheets

PROIOR ART

ELECTRICAL CONNECTOR ASSEMBLY

BACKGROUND OF THE INVENTION

1. Field of the Invention

The present invention relates to an electrical connector assembly, particularly to an electrical connector assembly for receiving chip modules therein.

2. Description of the Prior Art

A conventional electrical connector assembly as shown in U.S. Pat. No. 6,610,254 comprises contacting pins and the pins use spurs or tabs projecting from the implanted portion to assist in holding the contact in place and in reducing transmission of the stress to the solder tails on the interconnect end. The spurs provide additional points of contact with the inner wall surfaces of the apertures in the base member and provide balancing force to those being imposed by the package.

Another conventional electrical connector assembly 5' for testing a retaining chip modules therein is disclosed in FIGS. 1-3. The electrical connector assembly 1' comprises a housing 10', an operating member 11' and a cover 12' pivotally engaged with a side of the housing 10', and a shaft 14' connecting the cover 12' and the housing 10', a plurality of terminals 13' received in the housing 10'. The housing 10' defines a number of passageways 110' respectively for receiving the terminals 13' therein and the operating member 11' defines a number of receiving slots 110' in correspondence with passageways 100' of the housing 10'. The terminal 13' comprises a contact engaging portion 131' received in the passageways 100', an retaining portion 132' received in the receiving slot 110', a tail 133' connecting to the printed circuit board and a neck 134' for connecting the connecting retaining 132' and the contact engaging portion 131'. The chip module 2' defines a plurality of solder balls 20' for electrically engaging with the contact engaging portion 131' of the terminals 13'.

In assembly, the cover 12' is first opened and then put the chip module 2' onto the operating member 11'. At this moment, the solder balls 20' of the chip module 2' are inserted into the passageways 100' of the housing 10'. Sequentially, the cover 12' is oriented to a horizontal position to locating on the housing 10'. The cover 12' presses the chip module 2' downwardly. At last, the solder balls 20' of the housing 10' are engaged with the contact engaging portion 131' of the terminals 13' received in the housing 10' so that the electrical connection of the electrical connector assembly 1' is attained.

However, the housing 10' and the cover 12' are conventional made of hard materials so that the tolerance between the housing 10 and the cover 12' are limited. The terminals 13' also have tolerance on manufacturing. When the operating member 11' is pressed downwardly, protruding portions of the contact engaging portions 131' extending outwardly from the housing 10' are not uniformity. When the protruding portion is shorter than a predetermine length, the contact engaging portion 131' is not engaged with the solder balls, hence the chip module 2' not connecting with the terminals 13'. When the protruding portion is longer than the predetermine length, the contact engaging portion 13 scuffs the chip module.

Hence, an improved electrical connector bracket is required to overcome the disadvantages of the prior art.

BRIEF SUMMARY OF THE INVENTION

An object of the present invention is to provide an electrical connector assembly able to maintain a well contact between the chip module and the terminals.

An electrical connector assembly in accordance with a preferred embodiment of the present invention comprises a housing, an operating member, a cover pivotally engaged in one side of the housing, a shaft for connecting the cover to the housing and a plurality of terminals. The operating member defines a number of passageways, and the housing defines a plurality of receiving holes corresponding to the passageways. The terminal comprises a contact engaging portion received in the housing, an retaining portion received in the received hole, a tail connecting to the printed circuit board and a first connecting portion connecting the retaining portion and the contact engaging portion. The operating member is floatably supported by a first projection formed on the first connecting portion.

Relative to the present technology, the electrical connector assembly in accordance with the invention defines a pair of first projection abutting against the bottom surface of the operating member which can control the protruding length of the contact engaging portion inserted into the passageways, hence the chip module and the terminals attains a good electrical connection.

Other objects, advantages and novel features of the invention will become more apparent from the following detailed description of a preferred embodiment when taken in conjunction with the accompanying drawings.

DETAILED DESCRIPTION OF THE PREFERRED EMBODIMENTS

Figure 1:
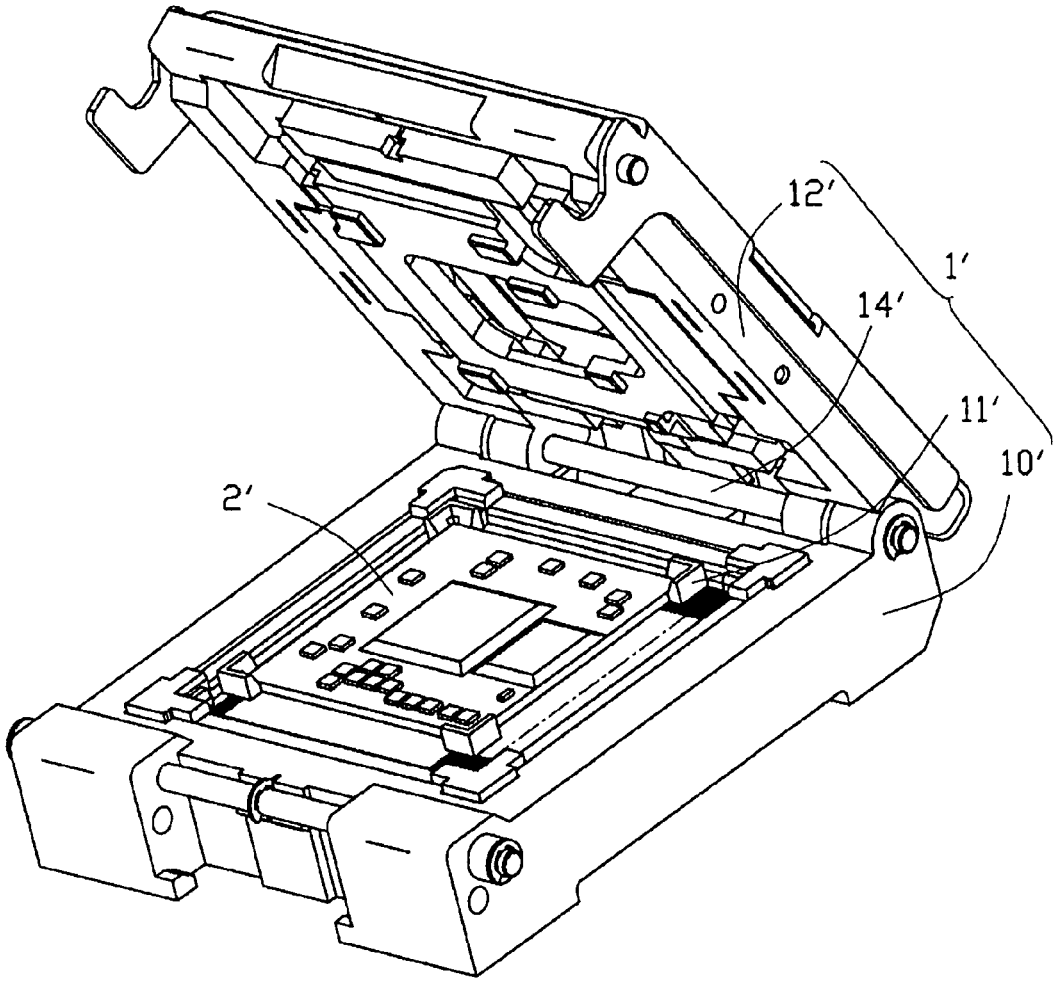
FIG. 1 is an isometric view of a conventional electrical connector assembly receiving a chip module therein.
Figure 2:
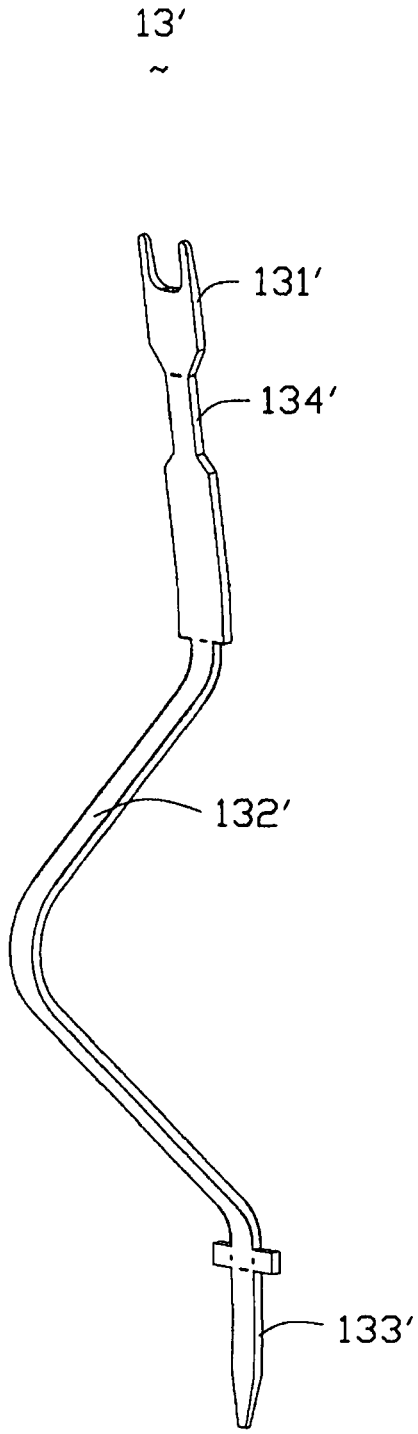
FIG. 2 PRIOR ART
FIG. 2 is an isometric view of a terminal assembled in the electrical connector assembly shown in FIG. 1.
Figure 3:
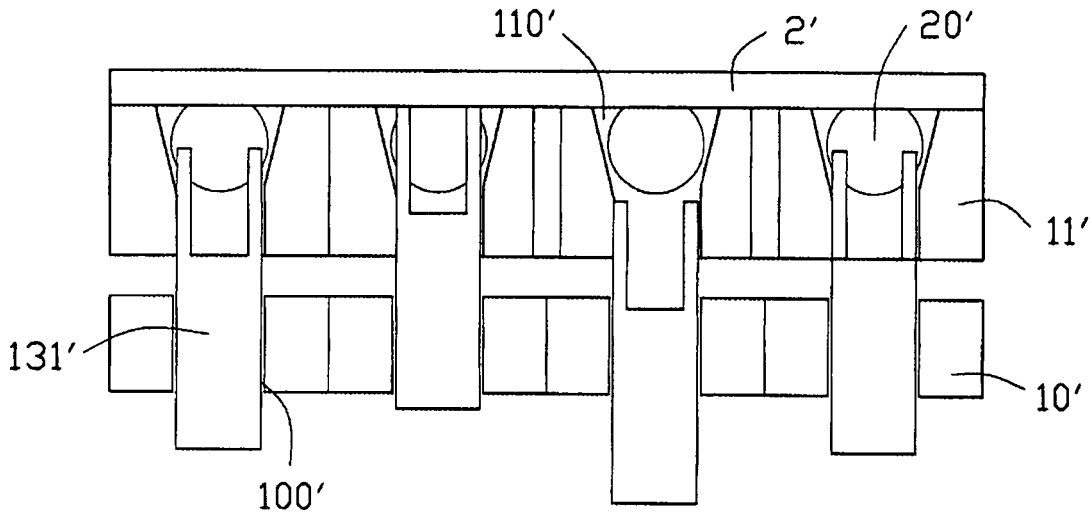
FIG. 3 PRIOR ART
FIG. 3 is a perspective view of the electrical connector assembly shown in FIG. 1, wherein the contact engaging portion of the terminal contacts with the chip module.
Figure 4:
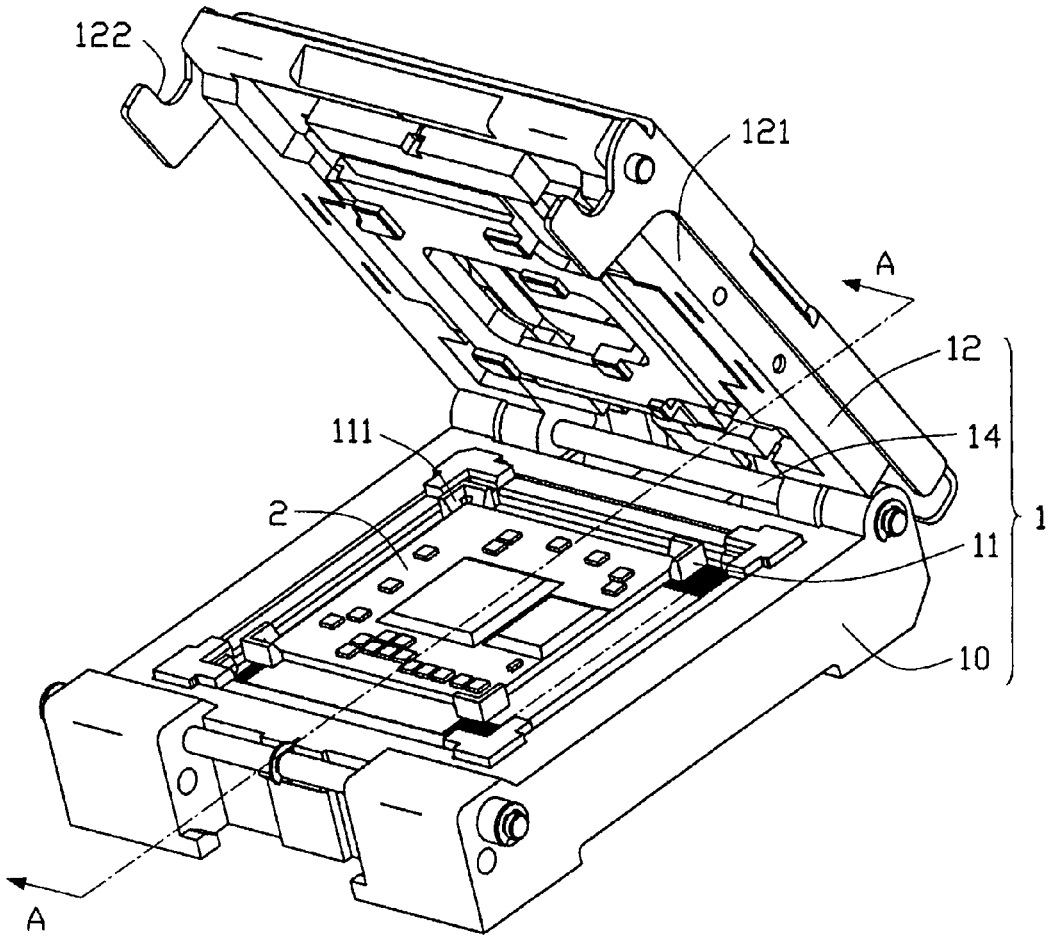
FIG. 4 is an isometric view of an electrical connector assembly receiving a chip module therein in accordance with a preferred embodiment of the invention.

Referring to FIGS. 4-7 an electrical connector assembly 1 comprises a housing 10, an operating member 11 mounted on the housing 10, a cover 12 pivotally engaged on a side of the housing 10, a shaft 14 for connecting the housing 10 and the cover 12, and a plurality of terminals 13.

The housing 10 is rectangular and defines a plurality of through passageways 100. The passageway 100 comprises an upper passageway 1001 disposed on an upper position a lower passageway (not labeled) disposed on a lower position thereof and a room 1002 communicating with the upper passageways 1001 and the lower passageway (not labeled).

The operating member 11 comprises a locating member 111 in the corner thereof for receiving the chip module 2 thereon and a plurality of receiving slots 110 for receiving the terminals 13.

The rectangular cover 12 comprises a frame 121 and a locking member 122 for locking the cover 12 on the housing 10.

Figure 5:
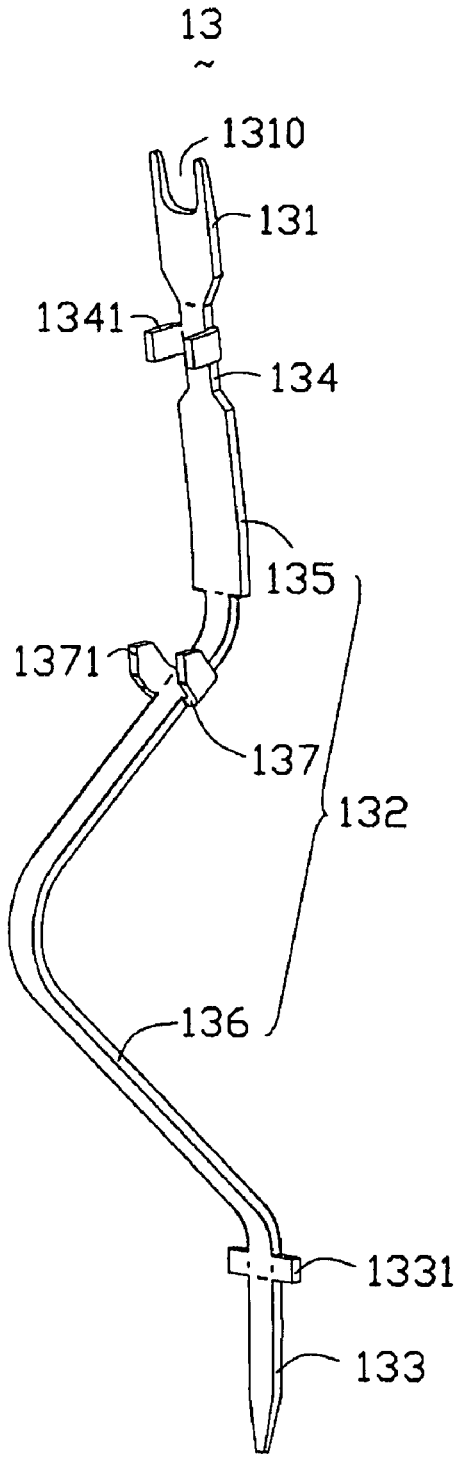
FIG. 5 is an isometric view of a terminal assembled in the electrical connector assembly shown in FIG. 4.
Figure 6:
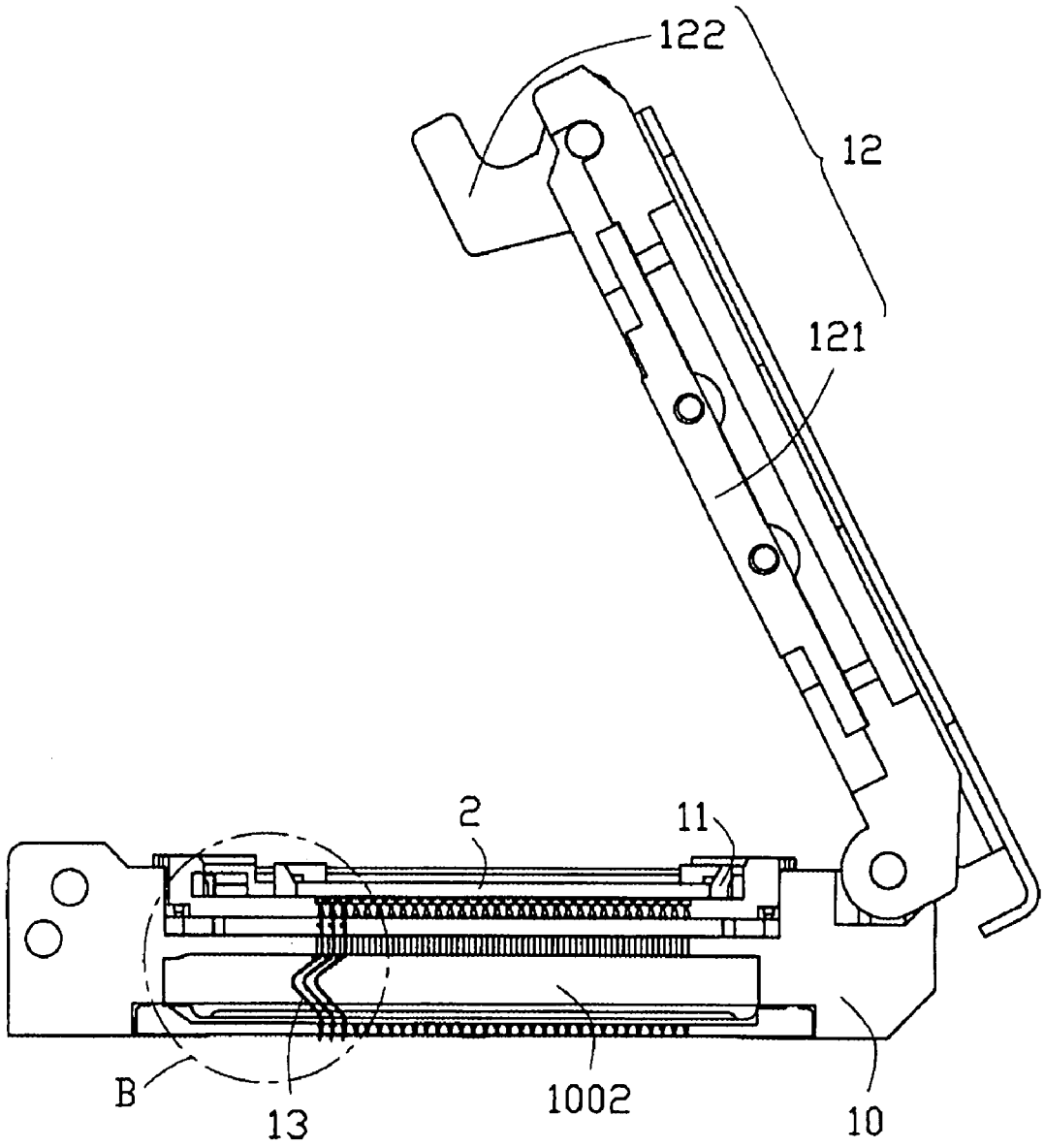
FIG. 6 is a cross-sectional view of the electrical connector assembly shown in FIG. 4 in a direction I-I.
Figure 7:
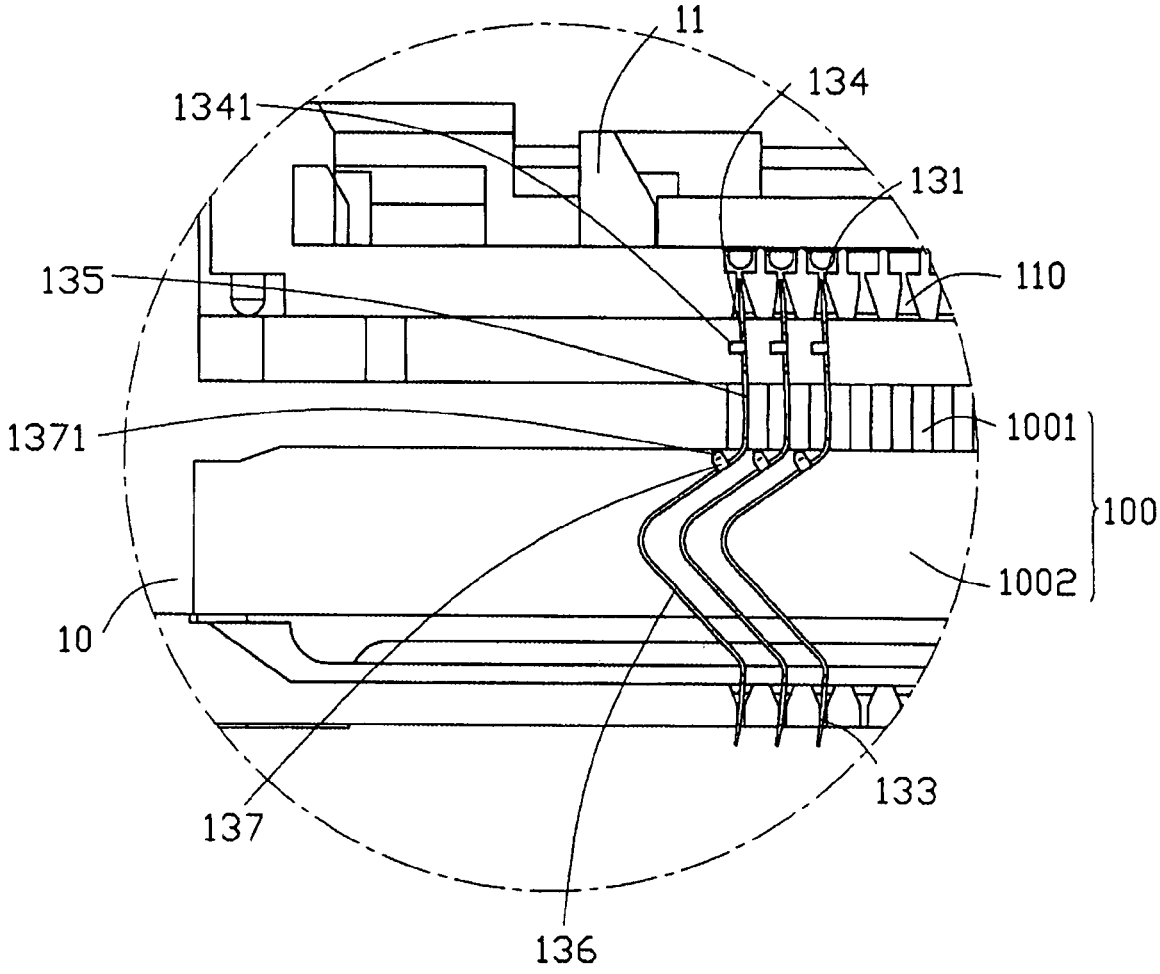
FIG. 7 is a amplified view of circle B shown in FIG. 6.

Referring to FIG 5, the terminal 13 comprises a contact engaging portion 131 extending out of a top surface of the housing 10 and received in the receiving slot 110 of the operating member 11, a retaining portion 132 received in the housing 10, a tail 133 extending out of a bottom surface of the housing 10 for connecting with the printed circuit board (not shown).

The contact engaging portion 131 received in the receiving slot 110 of the operating member 11 is conventionally planar and further comprises an opening 1310 for receiving the solder ball 20 disposed on a lower surface of the chip module 2.

The retaining portion 132 comprises a neck portion 134, a leading portion 135, an elastic portion 136 received in the room 1002 and a connecting portion 137 for connecting the leading portion 135 and the elastic portion 136. The leading portion 135 is inserted into the first passageways 1001. The elastic portion 136 is C-shaped and located in the room 1002. The elastic portion 136 can provide an elastic deformation for altering the length of the contact engaging portion 131 inserted into the receiving slot 110. The connecting portion 137 defines a pair of second projections 1371 for controlling the deformation of the elastic portion 136, and the second projections 1371 only move in the room 1002, and can not move into the first passageways 1001.

The tail 133 for connecting with the printed circuit board comprises a third projection 1331 to prevent the tail 133 from overly protruding out of the housing 10.

Figure 8:
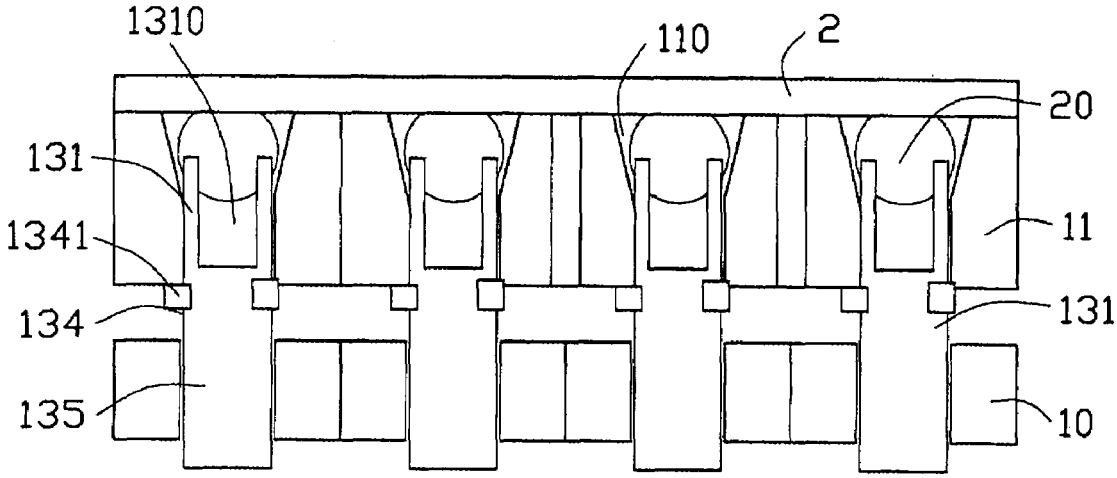
FIG. 8 is a perspective view of the electrical connector assembly shown in FIG. 7, wherein the contact engaging portion of the terminal contacts with the chip module.

Referring to FIG. 8, the neck portion 134 defines a pair of first projections 1341 and the shape of the first projection 1341 is not limited to rectangular or round shape. The first projection 1341 is disposed between the operating member 11 and the housing 10 for abutting against the operating member 11.

In assembly, the terminals 13 are firstly inserted into the housing 10, at this moment, the contact engaging portion 131 and the neck portion 134 with the first projections 1341 extend beyond a top surface of the housing 10, the leading portion 135 is received in the first passageways 1001, the elastic portion 136, the connecting portion 137 with the second projections 1371 are disposed in the room 1002, and the tail 133 extends beyond the housing 10. Then, the operating member 11 and the chip module 2 are mounted on the housing 10 in turn. The solder balls 20 of the chip module 2 are inserted into the receiving holes 110, the first projections 1341 of the neck portion 134 are disposed between the operating member 11 and the housing 10, the contacting engaging portion 131 inserts into the receiving slot 110 of the operating member 11. Sequentially, the cover 12 is pivotally mounted on the housing 10 and locked on the housing 10 by the locking member 122. When the cover 12 presses the chip module 2 downwardly, the operating member 11 is urged to downwardly move, so the contact engaging portion 131 of the terminal 13 upwardly moves along the receiving slot 110 relative to the operating member 11 to electrically contact with the solder ball 20 of the chip module 2. However, the first projection 1341 disposed below the operating member 11 can abut against a bottom surface of the operating member 11 to limit the length of the contact engaging portion 131 in the receiving slot 110 and prevent the contact engaging portion 131 from damaging the chip module 2. The chip module 2 and the terminals 13 can attain a well electrical connection.

It will be understood that the invention may be embodied in other specific forms without departing from the spirit or central characteristics thereof. The present examples and embodiments, therefore, are to be considered in all respects as illustrative and not restrictive, and the invention is not be limited to the details given herein.

What is claimed is:

1. An electrical connector assembly comprising:

a housing defining a number of passageways;

a plurality of terminals received in the passageways, each terminal including a containing retaining portion received in the passageways of the housing and a contact engaging portion extending beyond a top surface of the housing, the retaining portion formed with an elastic portion which is capable of altering a protruding length of the contact engaging portion out of the housing;

an operating member mounted on the housing and comprising a number of receiving slots in correspondence to the passageways receiving the contact engaging portion therein;

wherein the terminal defines at least a first projection abutting against a bottom surface of the operating member to prevent the contact engaging portion from overly inserting into the receiving slot of the operating member;

wherein the retaining portion includes a neck portion connecting the contact engaging portion and the retaining portion and being disposed between the operating member and the housing, said at least a first projection extends from the neck portion;

wherein the retaining portion further comprises a leading portion, an elastic portion and a connecting portion connecting the leading portion and the elastic portion, the housing has a room receiving the elastic portion; and wherein the terminal further comprises a second projection disposed on two sides of the connecting portion.

2. The electrical connector assembly as claimed in claim 1, wherein the terminal further comprises a tail for connecting with a printed circuit board and a third projection disposed on two sides of the tail.

3. An electrical connector assembly comprising:

a housing defining a number of passageways;

a plurality of terminals received in the passageways, each terminal including a retaining portion received in the passageways of the housing and retaining the terminal in the housing without possibility of upward movement and a contact engaging portion extending beyond a top surface of the housing;

an operating member mounted on the housing and comprising a number of receiving slot in correspondence to the passageways receiving the contact engaging portion therein; and a chip module seated upon the operating member and downwardly pressing the corresponding contact engaging portions; wherein the contact engaging portion of the contact terminal is formed with a projection engaging with a bottom surface of the operating member as so to prevent excessively upward movement of the terminal relative to the operating member;

wherein the retaining portion includes a neck portion connecting the contact engaging portion and the retaining portion and being disposed between the operating member and the housing, said at least a first projection extends from the neck portion;

wherein the retaining portion further comprises a leading portion, an elastic portion and a connecting portion connecting the leading portion and the elastic portion, the housing has a room receiving the elastic portion; and wherein the terminal further comprises a second projection disposed on two sides of the connecting portion.

4. The electrical connector assembly as claimed in claim 3 wherein said retaining portion is located around a lower portion of the housing.

* * * * *